US007555131B2

(12) United States Patent
Hollowbush et al.

(10) Patent No.: US 7,555,131 B2
(45) Date of Patent: Jun. 30, 2009

(54) MULTI-CHANNEL RELATIVE AMPLITUDE AND PHASE DISPLAY WITH LOGGING

(75) Inventors: Richard R. Hollowbush, Fleetwood, PA (US); Kenneth S. Altschuler, Pottstown, PA (US); David R. Guerrero, Center Valley, PA (US); Thomas J. Sollenberger, Collegeville, PA (US)

(73) Assignee: Harris Corporation, Melbourne, FL (US)

( * ) Notice: Subject to any disclaimer, the term of this patent is extended or adjusted under 35 U.S.C. 154(b) by 1006 days.

(21) Appl. No.: 10/813,798

(22) Filed: Mar. 31, 2004

(65) Prior Publication Data

US 2005/0226429 A1 Oct. 13, 2005

(51) Int. Cl.
*H04R 29/00* (2006.01)

(52) U.S. Cl. ..... 381/58

(58) Field of Classification Search ..... 381/12, 381/56, 58, 306; 345/440
See application file for complete search history.

(56) References Cited

U.S. PATENT DOCUMENTS 4,691,358 A * 9/1987 Bradford ..... 381/12
6,021,204 A * 2/2000 Eastty ..... 381/12
6,532,024 B1 * 3/2003 Everett et al. ..... 345/440
6,977,653 B1 * 12/2005 Cleary et al. ..... 381/56
2005/0042591 A1 * 2/2005 Bloom et al. ..... 434/307 A

* cited by examiner

*Primary Examiner*—Ping Lee
(74) *Attorney, Agent, or Firm*—Duane Morris LLP

(57) ABSTRACT

An audio test device and method provide a visual display of audio parameters for plural audio channels. One audio channel at least temporarily is deemed a reference channel and other channels become relative channel for comparison. Samples from the reference and relative channels produce relative amplitude and relative phase difference values that are plotted on the display. The difference values for pairs of relative channel and reference channel data samples can be plotted as pixels in pie shaped plot segments or other two dimensional plots, one for each relative channel. The relative amplitude and phase differences are presented as positions of pixels along the axes of the plot. This arrangement is particularly useful in showing the current amplitude and phase condition of a multi-channel audio signal. In addition, the amplitude and relative phase data for the channels can be logged over a long time period (a day or more) to show the amplitude and phase conditions as changing over time.

16 Claims, 4 Drawing Sheets

MULTI-CHANNEL RELATIVE AMPLITUDE AND PHASE DISPLAY WITH LOGGING

FIELD OF THE INVENTION

The invention relates to test apparatus and methods for analyzing the audio components of a multi-channel program such as a serial digital video program having five to eight or more audio signal channels. One channel is denominated at least temporarily as the reference channel. The relative amplitude and phase differences of two or more other channels, as compared to the reference channel (preferably the differences for all the other channels) are displayed in a multi-channel segmented visual plot. The invention provides a thorough but quick-reference visual presentation of the audio signal characteristics over all the program channels, and also provides for logging and plotting of audio characteristics, alarm conditions and the like, over selectable periods of time.

BACKGROUND OF THE INVENTION

Audio production equipment advantageously includes meters or readouts whereby an operator can determine various conditions that are pertinent to processing of the signal content, quality and other concerns. The moving display of a meter can provide information that is useful for various purposes and not only for the assurance that there is a signal present. A meter may provide a visual warning that the signal amplitude may be too high and may potentially cause clipping or distortion by overdriving audio amplifiers. The signal level may be low, potentially introducing hiss. Apart from signal amplitude, meters may be provided as indicators for other parameters, such as frequency spectrum, carrier modulation in a transmitter, etc. In this context, a "meter" might entail any of various changeable indicators such as movable pointers, a variable line of lamps or LEDs, changeable colors, and other indicating techniques.

In connection with amplitude meters, one conventional amplitude meter is the VU meter (an acronym for "volume units") and typically responds to an average level (such as the RMS average) over some sampling period. Another conventional type of meter is the PPM or program peak meter. The VU meter responds more slowly to changes in the signal amplitude than the PPM or peak meter, the response rate of the meter being sometimes termed the meter "ballistics."

VU and peak meters each produce valid information in their own way. For example, a VU meter gives a good measure of the loudness of a signal as subjectively perceived by humans. A peak meter gives a better indication as to whether amplifiers are being overdriven and so as to deteriorate the signal quality. A simple peak meter may have the disadvantage that in order to respond quickly to peaks, the meter cannot persist very long in displaying a signal level.

Meters for monitoring levels such as sound levels may have threshold detection aspects. In a meter with a graduated scale, the scale may have a "red line" area where the signal amplitude is considered too high. In a digital display having a line of LEDs or other individually controlled indicators to represent a variable line length, the indicators may have color warning attributes such as green for OK and red for overdriven.

A single meter may accommodate two types of meter ballistics in one display. Attempts to represent two or more variables in a display may be useful. The variables advantageously should be related to one another, and even though related, should be represented by distinctly different aspects of the display in some logical way. For example, peak and VU levels both represent signal amplitude. The peak indication can be represented by a distinct color and can be represented by a providing an indicator with a longer time of persistence of a peak indicator LED compared to a VU indicating one, which is curious because the shorter term variable (peak) is given a longer persistence than the longer term variable (VU).

A meter display or other presentation of data can be made unduly complicated. In a case where there is an effort to represent plural variables using different changeable display attributes, changes occur at the same time, possibly obscuring information in the complexity. Audio meter complexity is multiplied when attempting to provide indicators that represent multiple channels of audio. In particular, indicators lose much of their effectiveness in conveying information when three or more channels are involved.

In a stereo system, with two separate audio channels, the content of the channels might be different, but frequently stereo content has a directional or spatial aspect. For example the volume on two stereo channels might be varied to provide a realistic audio presentation of sound sources that should seem louder on one of the left and right side than the other, or sources that sound as though they are moving from left to right or vice versa. As a result, issues of phase relationship, relative volume and channel separation arise and may be pertinent in test equipment for use in producing, transmitting, or otherwise processing program content.

Test equipment that can usefully display a representation of differences in volume and phase at spaced audio speakers becomes involved when one has multiple channels, such as three or more channels, because the issues are no longer simply a matter of dual sources and a balance and/or phase relationship between the two sources. Digital video systems conventionally can have eight distinct channels. In comparison with a two channel stereo system in which one might be concerned with volume and left/right balance and phase relationship, in a multi-channel system one might want to compare any subset of one or more of the channels to any other subset of one or more channels.

With respect to the phase relationship between two signals such as a left and right audio channel, it is known to use a Lissajous display as an indicator. According to this technique, two periodic signals that are to be compared are applied to the horizontal and vertical inputs of a deflection apparatus such as an oscilloscope (or an analogous device). If the signals are equal in phase, a diagonal line is displayed. A static phase difference produces an oval or circle. Different frequencies produce more complex patterns and the patterns persist or change with changes in phase. This sort of a display becomes extremely cluttered by complex real world signals, particularly if the signals have a high degree of channel separation. Thus, the Lissajous display is often primarily useful as a visual indicator of the extent of channel separation.

In connect with audio systems having multiple channels (three or more), the complexity of highly variable visual displays presents a challenge. A meter or test apparatus with a visual display that is inherently complex becomes many times more complex with the presence of multiple channels because various comparisons are possible.

In a surround sound arrangement, an audio program conventionally has at least five channels, namely Left, Right, Center, Left Rear and Right Rear. Any pair of related channels (Left versus Right, Front versus Rear, etc.) presents the balance, separation and phasing issues comparable to two stereo channels. What is needed is a way to show the relationships among all the channels in a logical and intuitive form whereby a viewer can easily understand and work with the audio, such as monitoring attributes and adjusting hardware devices that are processing it, as necessary. It is possible envision a left/right balance display and a front/rear fade display that is complementary with balance and fade controls, but what would be more helpful and versatile is a test apparatus that is not limited to left/right and/or front/rear, and instead is capable of displays that present pertinent information as to any channel relationship and for a larger number of channels, such as eight channels. Such a versatile display would be useful apart from present rigid assignments between channels and speaker positions.

However many variations might be needed to enable a display to usefully compare all combinations of single channels or pairs if there are multiple channels available. These variations, multiplied by the complexity of selective pairings of channels and the possible need simultaneously to display relative amplitude or balance and relative phase information, could make a test apparatus display substantially too complex and difficult to understand, especially for persons who are not very familiar with the display. What is needed in a display is a presentation of information that is highly intuitive and provides a visual indication that clearly and logically provides the user with information needed about various audio parameters.

SUMMARY OF THE INVENTION

It is an object of the present invention to provide a graphic display apparatus and method that is better capable of quickly and intuitively conveying information about the state of an audio system having multiple channels (at least three) and potentially having numerous channels, such as a set of surround-sound channels, a number of embedded digitized channels in a digital program and other similar situations.

In addition to providing an immediate snapshot view of the state of several different signal amplitudes, the invention produces and plots relative phase and relative amplitude values. These values can be subject to selectable meter ballistics parameters (such as measured from peak or from VU RMS or using other ballistics as selected by the user). The values can show trends and include alarms and markers that are helpful in finding particular conditions after the fact and reviewing the associated data. The samples and/or derivations from the samples can be stored in a memory and plotted over a selected period. This period can be a short term such as a minute or a long term, for example up to 72 hours or more.

The display of the invention can relate channels in associated pairs or in arbitrary selections or in assigned arrays such as a surround sound array. Preferably in a multiple channel embodiment having eight channels, for example, data on all eight channels is at least selectively presented. The various channels are capable of association in sets other than simple left/right or front/rear pairs, and are arranged such that one or more of the channels can be deemed a reference for comparison with one or more other channels. In a paired channel arrangement, the relative phase between members of the pair is displayed as one parameter that is common to the pair. In an arrangement that is not limited to pairs, a channel can be deemed the reference channel, at least temporarily, and used as the other member of a logical pair against which one or more of the other channels, and preferably all the other channels, are compared for relative amplitude and relative phase.

Advantageously, the plot of relative amplitude and phase for multiple channels can be presented in association with a display of instantaneous amplitude or the like. The amplitude data can be collected subject to meter ballistics so as to relate closely to values that one might obtain by monitoring with a meter such as a VU meter with a line display, or a VU meter with peak, etc. In a preferred arrangement the plot of relative amplitude and phase of each relative channels is plotted relative to a marked reference channel that can be selected by user input or according to a cycle or sequence in which one of two or more of the available channels is selected as the reference channel in turn. Relative amplitude and relative phase are plotted for successive audio samples in a digital data stream, along different axes of a plot. The plot can be according to Cartesian coordinates, but in a preferred arrangement a polar plot is provided. Advantageously, a surround sound or similar amplitude VU line meter graphic display is provided with a radiating pattern of amplitude meter lines, i.e., with VU meter lines representing each channel radiating from an origin point, with a radial gap from the origin providing space for an inventive two-variable display of differential amplitude and phase. Each channel is assigned to an angular sector and radial span associated with the VU meter line that is aligned to the sector. According to an inventive aspect, the relative phase and relative amplitude are plotted in the assigned sector, with the radius from the origin and the angle of divergence from the VU graph line, respectively representing the phase difference from zero to 180° and the relative amplitude difference up to ±20 dB.

These and other aspects are realized in a test apparatus according to the invention of the type wherein a multi-format multiple-channel display is composed by a display generator that develops a pixel data map and populates the map with data that is can be presented through a display driver to a standard computer display such as an XGA or VGA or the like. Alternatively the display can be generated using other display particulars, operating discrete LED or LCD elements or the like.

BRIEF DESCRIPTION OF THE DRAWINGS

A number of additional objects and aspects are apparent from the appended description and the associated illustrations of preferred embodiments, wherein.

DETAILED DESCRIPTION

Figure 1:
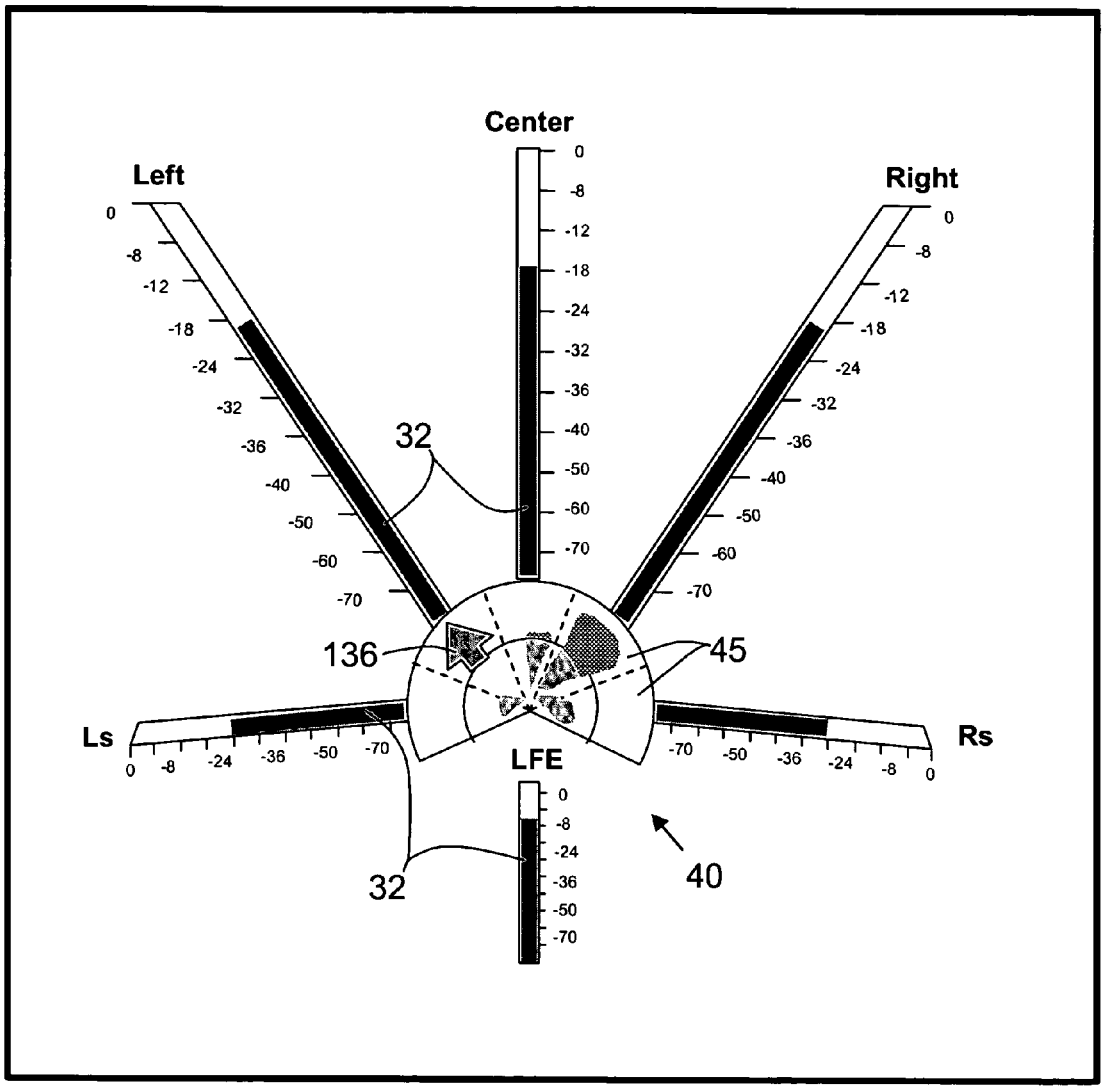
FIG. 1 is a graphic display layout according to an aspect of the invention, showing simultaneous displays of absolute audio amplitude and relative audio amplitude and phase angle, in a multi-channel audio system.
Figure 2:
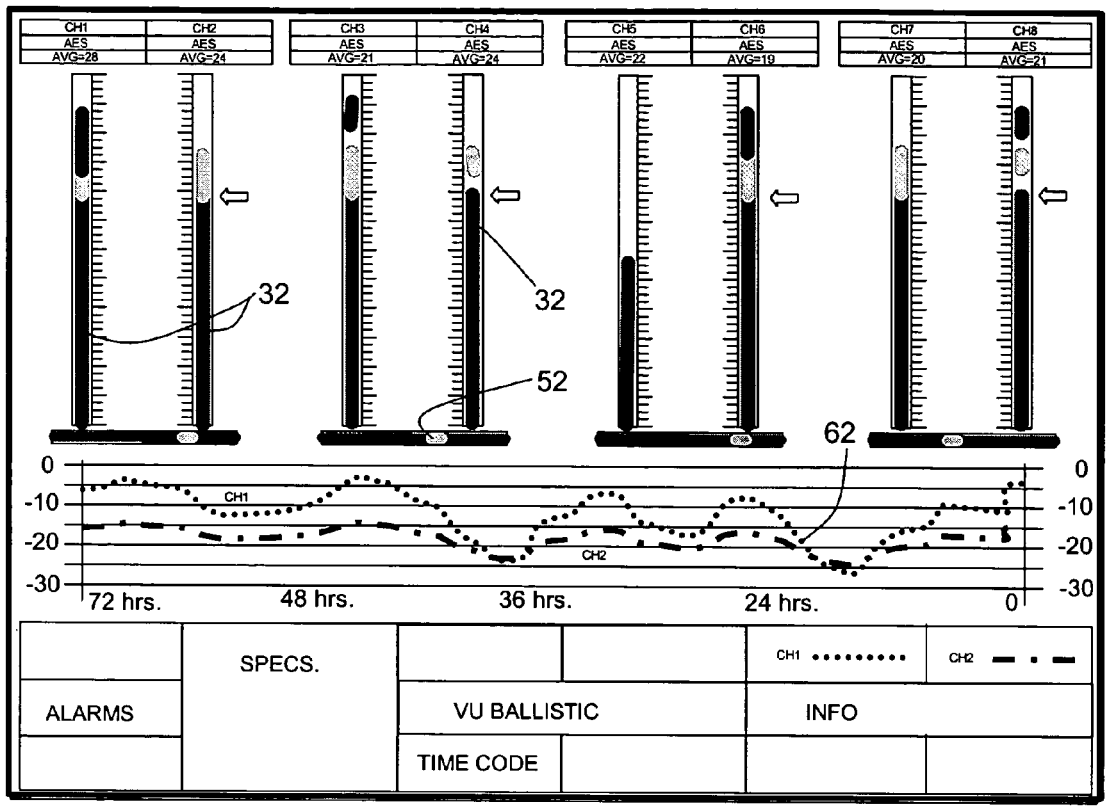
FIG. 2 is a graphic display layout according to another aspect, wherein amplitude and two channel phase are displayed, and also logged graphed over a long period.

Referring generally to FIGS. 1 and 2, the invention provides certain graphic displays for multiple-channel audio information, including signal amplitude on each of multiple audio channels, relative amplitude of one or more channels versus a reference channel and relative phase of one or more channels versus the reference channel. The invention is particularly applicable to multiple channel audio, i.e., having three or more channels, and is advantageous when used with a still larger number of channels such as five channels in a surround sound application or eight channels in connection with digital signals having embedded audio content.

The particular graphic displays shown are configured to produce a readily understandable view of the status of a multi-channel audio system, including facilitating certain measurements and comparisons that are of particular interest to audio and audio-visual programming. The displays are generated by continuously processing audio data samples at full speed, i.e., at the sampling rate that the samples are presented to output devices for playback through speakers (not shown). The samples are subjected to averaging, peak detection and other selectable meter ballistics used to produce meter displays, and the ballistics-affected data is collected and logged, optionally with further averaging for producing trending plots over a more or less recent history.

The nature of the variables that are displayed graphically, the form of the graphic displays, useful aspects related to channel and speaker positioning and phase cancellation, the application to multiple channels that can be displayed simultaneously, the long term data collection and plotting aspects, and the method by which the displays are obtained, all represent inventive aspects.

The graphic display configurations in FIGS. 1 and 2 have in common the aspect that there are linear display bars 32, one for each of multiple channels (at least three channels and preferably five or eight). The display bars 32 represent present audio levels that are determined subject to meter ballistics (e.g., running averages such as VU, peak detection and the like). In FIG. 1 the channels are shown in a surround-sound configuration comprising five channels that are oriented at the left, right, center front, left rear and side rear of an origin of center point, plus a sixth channel labeled "LFE" for substantially non-directional low frequency effects.

In a surround sound graphic display configuration as exemplified by the five linear graphics radiating as shown, the idea is that the relative volume of the channels shown in the graphic display correspond to the relative volume of speakers that are placed and oriented substantially to correspond to the directions of the radiating lines, except pointing inwardly toward a listener at the origin.

The display bars 32 as well as other particular indicia shown on the display, can be graphic elements of a video picture that is produced by a display generator (not shown). The colors of pixels in the display are mapped to represent the different meters and selected display formats. The mapped data is suitable, for example for XGA, VGA, RBG, YCbCr sampled or other popular formats to be displayed by an associated display device, transmitted to a remote device or otherwise employed.

In the embodiment of FIG. 2, eight channels are represented by line amplitude graphic bars. The channels in this case are disposed in pairs. It is sometimes desirable to consider audio data by pairs of channels when working with program recording and playback. Considering volume alone for example, the balance from left to right is a concern, as is the front-rear face control. These balances are maintained by establishing a nominal relative amplitude that produces desired subjective effects on the listeners and does not overdrive or under-drive any of the audio processing equipment. However, pairings of selected channels are not a complete picture of the audio data contained on the multiple channels.

In addition maintaining a nominal relative audio amplitude between two sources of sound, a second important consideration is the phase difference. When two spaced sources produce acoustic waves, an interference pattern of peak amplitude positions and phase interference or null amplitude positions occurs. When two audio signals are unrelated and highly variable, the interference pattern changes rapidly and any phase cancellation effects are not noticed. However, in multi-channel audio, one primary effect is to cause the source of a sound appear to move relative to the listener. This effect is achieved by varying the relative amplitude of the sound that the source supposedly is generating, i.e., the source sound becoming louder in a direction that the moving sound source is ostensibly approaching and dropping off in volume in the direction from which the sound source is ostensibly moving away. Phase cancellation can be an issue in connection with sounds produced at spaced sources.

In FIG. 2, some decisions may have been made as to which of various audio channels are to be paired (eight being shown). As paired in this way, one can determine the phase difference between the audio signals on the two channels in each pair. However such pairing does not wholly resolve issues of amplitude and relative phase, because for each directional speaker orientation or channel, for example as shown in FIG. 1, there are amplitude and phase relationships with several other channels. By switching which of several channels should be paired together, the display in FIG. 2 provides a technique for amplitude and phase comparison, namely by choosing which, of the eight channels provided, to compare graphically against which other of the eight channels. Preferably, the display can demonstrate comparison of a given channel against all the other channels, thus simultaneously presenting all the multiple channels at once (e.g., eight channels).

According to an inventive aspect shown in FIG. 1, the invention can compare any or all of the multiple channels together. One channels is deemed a reference channel and is compared against the other channels using a graphic display technique that plots the relative amplitudes and phase difference characteristics for each of the channels versus the reference channel, displaying all the channels. The channel that is deemed the reference can be changed, for example by responding to a user selection or by cycling through a sequence wherein each of the available channels is temporarily selected to serve as the reference channel in turn.

The audio bar displays 32 in the embodiments shown in FIGS. 1 and 2 comprise substantially conventional audio amplitude graphs. The signal amplitude (typically voltage at a point in a signal path or numeric absolute value in a range of possible values) is applied to a low pass function such as a root-mean-square (RMS) or running averaging function over some succession of samples. Such an average is typically considered to produce a VU or volume-unit display function in which averaging tends to suppress the appearance of brief peaks (the extent of instantaneous versus damped response being known as a meter ballistics parameter). As shown in FIG. 2, the line graphs can have supplemental markers, shades or graphs in contrasting shades to also indicate true peak values, average peak values and the like.

The invention is applicable to displays that produce audio graphic data in these and any other similar ways. Line plots and similar graphics are intended to simulate a meter. The line plots can be produced in various ways such as selectively lighting LEDs or LCD increments in a line that could be straight or curved into an arc or otherwise shaped. In a preferred arrangement of the present invention, the line plots and other aspects of the depicted display configurations are preferably produced by supplying data to a display processor that composes a display in a pixel memory, supplying contrasting color data to provide contrasting elements in the visible display that is produced, such a using a particular color to indicate a variable length along a meter-simulating line in the display.

The amplitude display lines 32 in FIGS. 1 and 2 are graduated with scale marks, the marks in FIG. 1 being labeled with dB values respecting some reference maximum level. The scales and graduations for the amplitude lines 32 are conventional. However, in addition to the display of amplitude lines 32, the display configuration in FIG. 1 has a relative amplitude and relative phase display 40 disposed at the origin of the multiple channel display. This relative display plot shows both relative amplitude and phase characteristics, and applies to all of the included channels, using one display graph.

Figure 3:
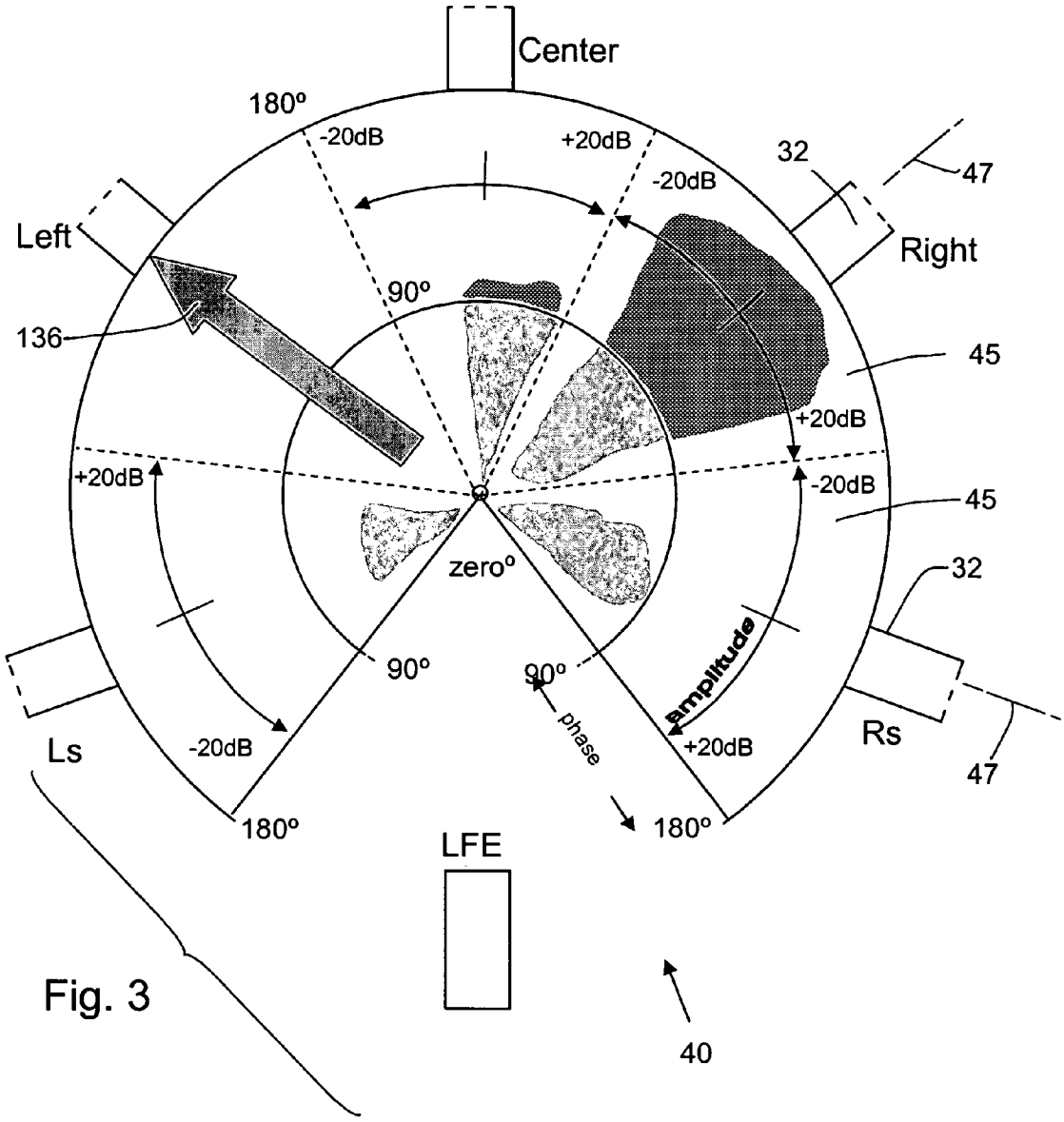
FIG. 3 is a detailed view showing a part of the display configuration in FIG. 1, wherein relative amplitude and phase are displayed graphically.

FIG. 3 shows the relative amplitude and relative phase plot 40 in somewhat greater detail but including the data also shown as an example in FIG. 1. The data plot is produced by processing audio sample values for all the channels involved. The data can be plotted for every passing sample and channel, or the samples can be decimated to produce a similar but less extensive display. In a preferred arrangement, the data are effectively reduced or the number of channels is decimated, by using the meter ballistics to produce at least some of the levels that are used in the relative data plotting and in logging and plotting for trends over time as discussed hereinafter.

The data plot 40 for showing relative amplitude and phase for the multiple channels versus the reference channel, as shown in FIG. 3, is a two dimensional configuration. Each of the Ls, Left, Center, Right and Rs channels has a pie shaped angular segment 45 in display 40. The pie shaped angular segments 45 are symmetrically related to the origin and align with the line graphs 32 that carry the VU or similar amplitude line graphs as shown in FIG. 1 (the line graphs being shown cut-away in FIG. 3). Each pie shaped angular segment 45 encompasses a span of radial distance and an angle related to the number of channels and segments shown (e.g., five segments of about 45° each being provided in the example shown. According to an aspect of the invention, each of these angular segments 45 forms a two dimensional plot of data representing differential amplitude on one polar plot coordinate (angle in this example) and differential phase on another polar plot coordinate (radius). Each pie segment 45 plots differential amplitude and phase angle difference for a respective channel versus the channel that is currently selected to be deemed the reference channel. The segment 45 for a channel is aligned with the amplitude graph line 32 for that same channel.

In the preferred embodiment shown in FIG. 3, the relative phase angle of a sample plots to the radius from the origin, within a span of zero to 180°. The relative amplitude is limited or clipped within a span of ±20 dB, and plots to an angle relative to the angle of the center line 47 of the amplitude bar graph for the respective channel.

As thus described, the central area around the origin in FIGS. 1 and 3 represents a set of graphs wherein the relative amplitude and phase for each relative channel, versus the currently deemed reference channel, are plotted in polar coordinates from a different origin aligned to the respective amplitude display bar graph or meter line 47.

In FIG. 2, the relative phase values in pairs of channels is shown by positioning a movable indicator at a point between the ends of a fixed line graph 52 that represents a phase difference between zero and 180'. In this embodiment, the relative amplitude and/or the relative phase also can be logged in a memory and plotted over a predetermined time interval in a log graph 62.

Figure 4:
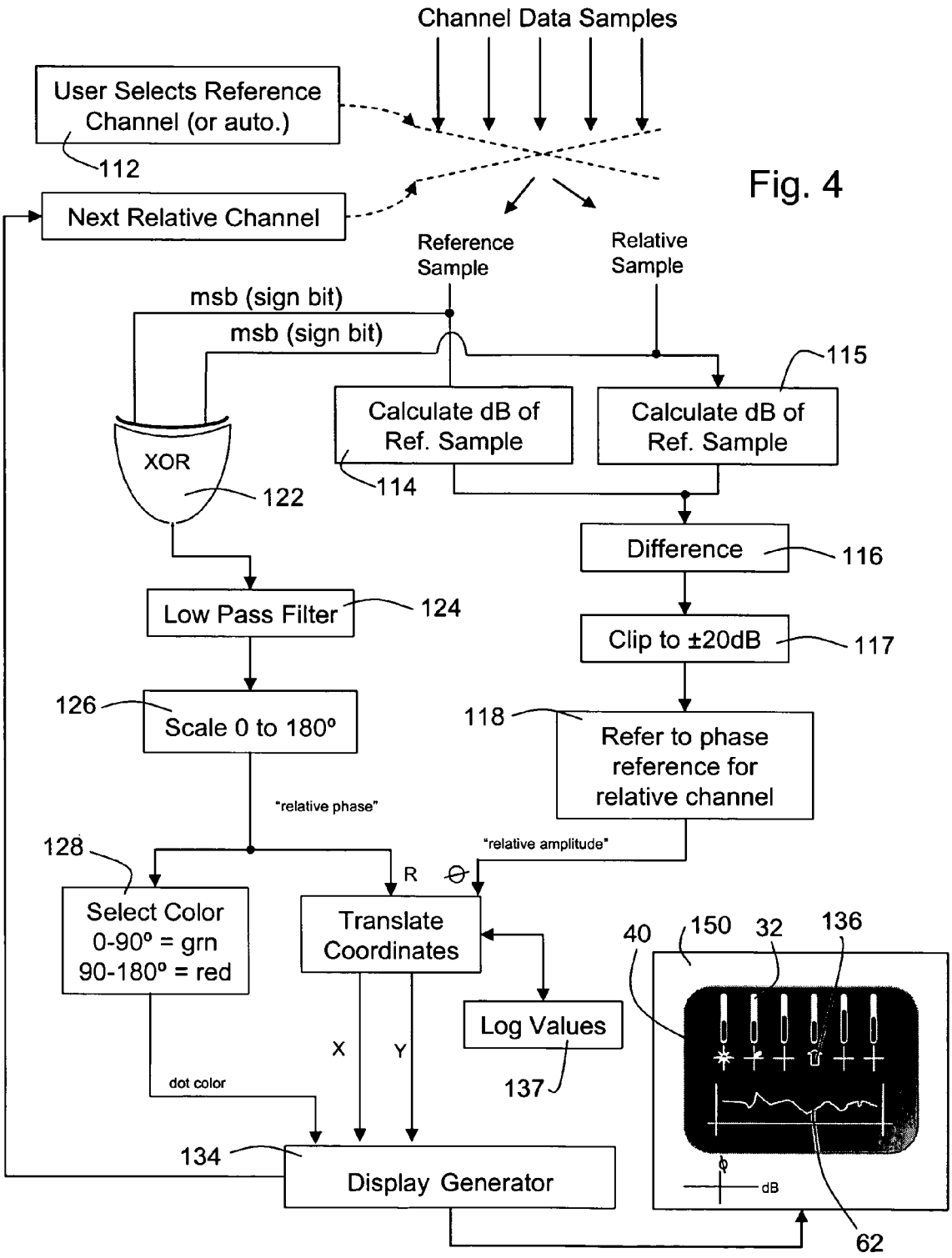
FIG. 4 is a data flow and block diagram illustration showing the steps undertaken in generating the subject displays.

FIG. 4 is a block diagram showing a flowchart of how the channel data sample values can be converted into a measure of relative phase and amplitude. The channel data samples 110 are provided, for example by extraction from a serial digital video program signal or from the output of an analog to digital converter (not shown). The samples can be provided, for example at a 48 KHz sampling rate, each sample on each channel being one eight bit byte with the most significant bit (msb) representing the sign.

The user can select a reference channel at block 112 in FIG. 4. Alternatively, the reference channel can be advanced from one of the multiple channels to a next at some time interval in a sequence. As another advantageous technique, the reference channel can be chosen by a triggering function, for example a threshold detection function applied to amplitude or phase conditions that relate to a particular channel or to a mode of operation.

The values (samples that can be subject to meter ballistics) are applied to calculation functions at blocks 114 and 115, to derive dB values from the sample values, which is primarily a matter of mathematically converting the sample amplitude values to a logarithmic scale. The difference between dB scaled values is taken at block 116 and clipped to a max of ±20 dB at block 117. The resulting value is to become a position along one of the two coordinates on which points are to be plotted in the segment 45 used for the respective channel. The difference between the level of the reference and relative channel, stated in a dB scale difference, is to be plotted as an angle around an origin corresponding to the center line 47 of the associated amplitude bar plot 32 as shown in FIG. 3. Therefore, the particular phase angle obtained is added to the phase angle of the center line 47 at block 118, to provide an angle for the sample around the span of the display zone 40, which in the example shown has been arbitrarily made less than a full 360°.

The other axis is to represent the phase difference and is likewise determined between the reference channel and each of the relative channels. This value is plotted as a point along a radius in the angular segment 45 that corresponds to and aligns with an associated amplitude bar plot 32.

The phase difference is determined by comparing the most significant bits of the reference and relative samples, the most significant bits representing a positive (0) or negative (1) value in two's complement binary. The most significant bits are applied to an exclusive OR gate 122 that determines whether the signs are the same (which is interpreted as in phase) or different (out of phase).

The precise phase relationship of the reference and relative channels is a potentially complicated mathematical matter that is in part a function of the frequency component at which one assesses the phase relationship. However, by checking the correspondence of the sign values for every sample (or perhaps a statistically relevant sampling of the samples), a variable value is developed that varies together with the phase relationship of all component frequencies for which the sampling rate is high enough to function as an effective Nyquist sample rate.

The output of the exclusive OR function is applied to a low pass filter 124 and the output level is scaled at functional block 126 to equate the span between the minimum and maximum output values as a span of zero to 180° of phase difference. A difference between 180° and 360° is indistinguishable from 180° to zero insofar as phase cancellation effects are concerned, as well as in operation of the foregoing measurement circuit. The phase difference value between zero and 180° is used to determine the radius coordinate R of samples plotted in the pie shaped segment 45 of corresponding to the channel of the samples, to be plotted with the angular coordinate Θ from the relative amplitude.

Generally speaking, a phase difference that approaches 180° between associated audio channels is undesirable due to potential phase cancellation effects. The invention preferably displays phase differences between 90° and 180° with particular emphasis, suggesting a potential problem condition. According to FIG. 4, it is possible selectively to vary the color of the pixel used to plot a sample so that samples plotting to a high phase difference approaching 180° are shown as red, for example, whereas samples at less then 90° phase difference are shown as green. This can be a continuous function (i.e., progressively brighter red with higher phase difference) or can be a threshold matter as suggested by FIG. 3, wherein samples with phases from zero to 90° can be plotted in one form (e.g., a color such as green) and samples with phases from 90 to 180° are shown in a distinct form (e.g., an alarm color such as orange or red).

The segmented polar form for plotting samples by phase difference (radius) and relative amplitude difference (angle of displacement from one of the angularly spaced channel reference angles) has the inherent effect of emphasizing samples having a higher difference in phase over samples with a lower difference in phase. Given equal amplitude difference values, two samples having a smaller phase difference are plotted closer to the origin and encompass a smaller area than the same amplitude difference if plotted at a greater distance from the origin.

In any event, the phase difference value (variable R in FIG. 4) and the amplitude difference value (Θ) are applied to a coordinate translation function at block 132 that converts the polar coordinates in each segment 45 into X-Y coordinates of a screen display 150. This display can be a computer type monitor or another form of display capable of being driven by a display generator 134 responsive to the values developed as discussed above.

The invention in general is a test apparatus for visual display of audio parameters of multiple audio channels, such as the different channels of a surround sound arrangement (FIG. 1) or a set of channels that are simply available for use together (FIG. 2), perhaps being embedded in an audio visual digital signal. The apparatus receives an input for receiving at least one input signal. The channels could conceivably be assembled from plural input signals, but in any event, at least one audio channel that is received or made available at least temporarily forms a reference channel. Plural other channels are then applied against the reference channel as relative channels, producing difference values that compare audio parameters between the relative channel and the reference channel. In the preferred embodiment, a reference channel is compared to several relative channels. The resulting difference values are presented simultaneously. After some interval, a different one of the multiple channels can be deemed the reference channel and compared against all the others, whereupon the original reference channel becomes one of the relative channels in a new set of simultaneous plots.

An amplitude measurement circuit is operable to determine a relative amplitude of the relative channel versus the reference channel. This can be a direct mathematical comparison in a digital embodiment. In an analog embodiment, the relative amplitudes can be represented by an analog signal, or two or more analog input signals can be digitized and treated numerically. In one embodiment, the relative amplitudes are represented by values that are subject to meter ballistics, e.g., being the result of a running average or RMS calculation over a predetermined number of samples.

A phase comparator determines a relative phase difference of the relative channel versus the reference channel. Thus the apparatus develops relative amplitude and relative phase variable values by comparing the reference and relative channel sample values, and the output of that comparison can be low-pass filtered (which similarly is a form of averaging). Preferably, a phase comparison is accomplished for each concurrently available sample for each channel in a signal stream, such as the embedded audio portion of a serial digital video program.

According to an inventive aspect, a visual display is developed responsive to the relative amplitude and the relative phase difference of the samples. The relative amplitude and the relative phase differences are presented on a same graphic plot on the visual display. In one embodiment, the relative amplitude and relative phase values are presented in the graphic plot for a given comparison of two audio samples, a pixel or point plotted to a position on a two dimensional plot. In a preferred embodiment, the plot for the relative channel presents the relative amplitude and the relative phase values as values of two variables in a two dimensional graphic plot. These distances can be shown in a polar coordinate form (FIGS. 1, 3). It is also possible to use a Cartesian coordinate form (FIG. 4, element 150), but the polar coordinates form using radius to show phase angle and angular displacement from a segment center to show relative amplitude, are advantageous because the resulting plot clearly and intuitively shows the state of multiple channels at the same time.

In an advantageous embodiment, as shown in FIGS. 1 and 3, a separate graphic plot or zone 45 is provided and defines a plotting area with two coordinates for representing the relative channel versus the reference channels with the relative amplitude and relative phase values representing the two coordinates in the two dimensional plot.

In the embodiments of FIGS. 1 and 2, the graphic display also shows the value of an absolute parameter for each of the plural channels. This value is specific to the associated channel, as opposed to relating to two channels. The amplitude of the associated channel is advantageously displayed as the value. Inasmuch as this is one variable rather than two variable, a bar or line presentation 32 is preferred, wherein the plotted value is represented by a variable position of a point along a line or a variable line length, etc. This amplitude variable (subject to meter ballistics) is shown for all the multiple channels, including the relative channels and the channel that at the moment is deemed to be the reference channel.

Line or bar graphs 32 for several associated channels can be displayed together. The respective line or bar graphs 32 can define a spatial array in which the orientation of the line or bar corresponds to a speaker orientation (front-rear, left-right, etc.). Advantageously, the separate graphic plots and/or plot areas 45 that are provided for showing the respective values of the reference and relative channel data are located so as to be visibly referenced the line or bar graph, or to another part of graphic display, that corresponds to the relative audio channel for which the data appears in that graphic plot or area 45.

As an example, the graphic display can include a bar or line graph 32 showing signal amplitude as a variable position along a line. That amplitude is the absolute parameter for the associated channel. The relative amplitude and relative phase graph can be plotted on an origin or other reference coordinate generally along an extension of the bar or line graph 32, whereas the other of the relative amplitude and phase is plotted as a coordinate generally lateral to such bar or line graph 32.

In an embodiment wherein bar or line graphs 32 plotting signal amplitude for each of the plurality of channels are presented in a radiating pattern corresponding to nominal speaker positions for said channels (FIGS. 1 and 3), the relative amplitude of each respective relative channel is plotted as an angular deflection (Θ in FIG. 4) from the angle of an associated line 47 (FIG. 3), and the relative phase (R in FIG. 4) is plotted as a radius along that line, concentric with the line 47.

The result as best shown in FIG. 3 is that the plot of a pixel position comparing the reference and relative channel sample values produces a relative amplitude value and a relative phase value that define displacements along coordinate axes. The pixel position can be plotted in a substantially circular area around an origin having angular sectors 45 associated with each of the lines 32, 47 plotting signal amplitude. Each sector 45 provides a small polar plot in pie shaped area showing the relative phase of the associated channel, represented as a radius from the origin, and the relative amplitude of the associated channel, represented as an angular deflection from the associated line representing signal amplitude. This arrangement is advantageous for providing a quick an intuitive view of the audio state of a multi-channel audio signal.

The graphic display contains a marker designating the reference channel, rather than a plot, such as an arrow, a highlight color or some other distinguishing indicia. The selection of the reference channel from among the plural audio channels is changeable by at least one of a user selection input, a cyclic selection of channels in turn, and occurrence of a triggering condition associated with one of the audio channels.

The foregoing radiating configuration of the plots of relative phase and relative amplitude information are advantageous but are not entirely mandatory. The plots also could be based on Cartesian coordinate graphs, paired channel relative phase graphs and other plots of phase and/or amplitude data. In FIG. 2, the data for samples is logged and plotted as a function of time. In this case the apparatus further comprises a data store for values shown by the plot 62 in FIG. 2, such as a log representing at least one of the relative amplitude and the relative phase values of the relative channel over a period of time, an extract of such data such as meter-ballistics averages, other running averages or a subset or selection of values. The apparatus of the invention can be switchable between the log readout plot 62 (FIG. 2) and the bar graph depiction also shown. Alternatively, the apparatus can be switchable between the log plot and the spatially oriented plot in FIGS. 1 and 3. In any event, the apparatus has at least one mode of the visual display wherein the log is plotted over a progression of samples and/or a period of time.

The log data can be stored or regenerated based on calculated average levels. In that case the trending plot of a selected period of time can present a calculated display of the average of the amplitude or phase by selected unit of time. The time increments can be selectable as desired, such as seconds, minutes, hours, days, etc.

According to an inventive aspect, the plot of log data can include marks placed at points where alarms occur. The marks can indicate, for example, violation of a user parameter setting (alarm) that defines a threshold or combination of thresholds of two or more variables. The alarm marks can include recordation and display of time stamp information at the point of the alarm, to facilitate analysis of conditions at and before or after the occurrence of the alarm.

The apparatus of the invention is not limited to channels that are carried in a digital stream from a given source, such as the embedded channels in a digital data stream. It is also possible to apply signals from different sources. It is also possible to apply the invention to a mix of analog and digital inputs together. A mixture of any format of audio can be displayed in any of the mentioned selectable screen formats shown or mentioned, e.g., by stereo pair, by other grouping or by the foregoing deemed-reference channel versus multiple relative channels technique.

The period of time can be made to represent quite a large number of samples, simply by providing for a running average or a technique to decimate the data developed by processing the successive samples. With a sampling rate of 48 KHz, and a potential logging time that can vary, for example from a minute to an hour to at least a day, preferably in selected increments up to at least 72 hours, vigorous decimation and averaging can be applied to control the number of points to be plotted. To avoid concealing peaks by such averaging techniques, the plot can include peak information as well as averages, in a manner similar to selectable VU and VU-plus-peak meter ballistic selections.

The apparatus can accept a digital input stream or can include a sampling analog to digital converter for providing time sampled values of signals on the plurality of channels. A mathematical processing circuit 114, 115, 122 (FIG. 4) provides from the sampled values at least one of an absolute amplitude value for each of at least two said channels, and relative comparisons of at least one of amplitude and phase for said at least two channels, whereof one of the channels is deemed a reference channel. A display generator 134 has at least one mode wherein the amplitude and phase values of the at least two channels are simultaneously graphically displayed.

A memory 137 can log or store at least one of the sampled values over time and processed values derived from the sampled values over time. The display generator has at least one mode for displaying a time log of contents of the memory 137 over time. The time can be substantial, e.g., at least 24 hours, by decimating or averaging the stored values.

In one embodiment, the display generator is configured to display selectively a plot of current data chosen from the group consisting of absolute channel amplitude, relative channel amplitude between identified channel pairs, relative phase between identified channel pairs, relative channel amplitude versus any selected one of the channels, relative channel phase versus any selected one of the channels, and a time plot of previous channel amplitude and phase data. These arrangements are represented in one or more of FIGS. 1 through 4.

In FIG. 3, the display generator has produced a graphic plot wherein a relative amplitude and a relative phase for at least one relative channel are presented in the graphic plot by points plotted for audio samples for at least the relative channel and the deemed reference channel. The graphic plot is a two dimensional plot wherein the relative amplitude and the relative phase are plotted along different coordinates to determine a pixel position.

The reference channel cannot meaningfully be compared against itself. Therefore, as shown in FIGS. 1 and 3, the display generator imposes a pointer such as arrow 136 to identify which of the channels is currently functioning as the reference channel. The reference channel is changeable, for example by user selection input, by cycling through the channels to have each channel function temporarily as the reference channel in turn, or if signal attributes trigger the selection of a particular channel as the reference due to some threshold detection step or other step.

The invention also comprises a method for representing an audio signal having multiple channels, where "multiple" denotes at least three and advantageously five or six or eight or more channels whose characteristics are displayed at once. The method comprises providing digitized amplitude time samples for a plurality of audio channels; at least temporarily deeming one of the channels as a reference channel for at least one other of the channels as a relative channel; determining a relative amplitude of the relative channel versus the reference channel; determining a relative phase of the relative channel versus the reference channel; and providing a display. The display preferably produces alternative displays. In at least one display mode, the relative amplitude and relative phase are plotted for current samples, preferably subject to metering ballistics, together with an absolute amplitude, or one of the relative amplitude and the relative phase is plotted over a period of time.

By changing the channel deemed as the reference channel, the various channels can be compared against one another, thereby revealing further attributes of the audio channels being processed. A change in the channel that is regarded as the reference channel is effected by at least one of a user input selection, a cyclic selection of channels in turn and occurrence of a triggering condition associated with on of the channels.

According to certain advantageous applications of the inventive method, spatial line plots of signal amplitude are presented in a pattern of varying length lines corresponding to signal amplitude for each of a plurality of channels, in a multi-channel VU meter configuration. Additionally, the relative amplitude and relative phase of at least one said relative channel is presented. This additional relative information is presented by plotting a pixel in a two dimensional plot in which the relative amplitude and the relative phase are measured by or represented as the pixel position along different coordinates, preferably using a polar coordinate system in which each channel is plotted in an angular segment associated with the corresponding spatial line plot or VU meter line for the at least one said relative channel.

By placing the spatial VU meter type line plots in a radiating pattern around an origin representing nominal speaker positions for playback of the channels, the relative amplitude and phase information can be spatially related to the VU meter display. In FIGS. 1 and 3, room for the individual two dimensional plots in pie segments around a circle is opened by spacing the spatial VU meter line plots outwardly by a radial distance from an origin. In this radial distance and in one or more angular spans, a polar plot of relative amplitude and relative phase can be presented for at least one relative channel, and preferably for all the channels (as relative channels) except the reference channel itself, which is preferably identified by an arrow or other pointer.

In separate pie shaped segments or angular sectors, relative phase between zero and 180° is plotted to a distance from the origin in the angular sector, and relative amplitude is plotted as circumferential displacement along an angle above and below an angle of the associated one of the line plots. Advantageously, phase differences near 180°, or at least above 90°, can be represented as an alarm condition by plotting a pixel with a distinct color representation.

The invention having been disclosed in connection with the foregoing preferred arrangements, variations will now be apparent, and should be considered encompassed within the scope and spirit of the invention.

What is claimed is:

1. A test apparatus for visual display of audio parameters of multiple audio channels, comprising:

an input to the test apparatus for receiving at least three audio channels;

wherein one of the audio channels at least temporarily forms a reference channel for comparison by the test apparatus with at least two other said channels, each of said at least two other channels at least temporarily forming a relative channel for comparison of said audio parameters between the relative channel and the reference channel;

an amplitude measurement circuit operable to determine a relative amplitude of the relative channel versus the reference channel;

a phase comparator operable to determine a relative phase difference of the relative channel versus the reference channel;

a visual display responsive to the relative amplitude and the relative phase difference, wherein the relative amplitude and the relative phase difference are presented on a same graphic plot on the visual display, in which relative amplitude and relative phase values are presented by a position of a point on a two dimensional plot for each said relative channel, wherein relative amplitude and relative phase are coordinates;

wherein the graphic plot comprises a polar plot having segments for the relative channels, in which segments a phase difference between the respective relative channel and the reference channel is plotted to a position along a radius of the polar plot, and a relative amplitude of the relative channel compared to the reference channel, is plotted to a position laterally spaced from the radius.

2. The test apparatus of claim 1, wherein the visual display further comprises a graphic display of an absolute parameter for each of a plurality of channels of the signal, wherein the segments for said at least two relative channels in the polar plot are respectively located to reference the graphic display of the absolute parameter for a corresponding one of the relative audio channels.

3. The test apparatus of claim 2, further comprising a meter line for plotting signal amplitude of each of a plurality of the audio channels, the meter lines for said plurality of channels being oriented to radiate from respective ones of the segments along a respective said radius of the polar plot.

4. The test apparatus of claim 1, wherein the visual display contains a marker designating the reference channel, and wherein a selection of the reference channel from among the audio channels is changeable.

5. The test apparatus of claim 4, wherein the selection of the reference channel from among the plural audio channels is changeable by at least one user selection input.

6. The test apparatus of claim 4, wherein the selection of the reference channel from among the plural audio channels is changeable by at least one user selection input.

7. The test apparatus of claim 4, wherein the selection of the reference channel from among the plural audio channels includes selection of cycling through different ones of the audio channels.

8. The test apparatus of claim 1, further comprising a storage device operable to store for a period of time a log representing at least one of values of samples, relative amplitude and phase values, and processed data based on at least one of the sample values and relative amplitude and phase values, and further comprising at least a mode of the visual display wherein the log is plotted.

9. The test apparatus of claim 8, wherein said at least one of the relative amplitude and the relative phase values are reduced by at least one of decimation and averaging, for providing alternative plots over different lengths of time.

10. The test apparatus of claim 9, wherein at least two amplitude values and at least one phase value are selectively displayable for a length of time of at least one minute.

11. The test apparatus of claim 1, wherein the audio channels carry time sampled digital amplitude values of signals on the plurality of channels;

further comprising a mathematical processing circuit operable to provide from the sampled values at least one of an absolute amplitude value for each of at least two said channels, and relative comparisons of at least one of amplitude and phase for said at least two channels for a time period equal to at least one time sample, for providing the phase difference and the relative amplitude corresponding to the position of the point on the two dimensional plot.

12. A method for representing an audio signal having multiple channels associated with a program, on a graphic plot, comprising the steps of:

providing digitized amplitude time samples for a plurality of said channels;

at least temporarily deeming one of the channels as a reference channel for at least two other of the channels as relative channels;

determining a relative amplitude of each said relative channel versus the reference channel;

determining a relative phase of each said relative channel versus the reference channel;

changing the channel deemed as the reference channel according to at least one of a user selection and an automatic selection; and, providing a display having at least one mode wherein the relative amplitude and relative phase are plotted for current samples; and, wherein relative amplitude and relative phase values are presented by a position of a point on a two dimensional plot for each of the relative channels, wherein relative amplitude and relative phase are coordinates;

wherein the graphic plot comprises a polar plot having segments for the relative channels, in which segments a phase difference between the respective relative channel and the reference channel is plotted to a position along a radius of the polar plot, and a relative amplitude of the relative channel compared to the reference channel, is plotted to a position laterally spaced from the radius.

13. The method of claim 12, further comprising displaying spatial line plots of signal amplitude in a pattern of varying length lines corresponding to signal amplitude for each of a plurality of channels.

14. The method of claim 13, further comprising placing the spatial line plots in a radiating pattern around an origin representing nominal speaker positions for playback of the channels, spacing the spatial lines plots by a radial distance from the origin, and plotting in the radial distance said polar plot of relative amplitude and relative phase for at least two said relative channels.

15. The method of claim 12, wherein relative phase between zero and 180° is plotted to a distance from an origin in the segments

16. The method of claim 15, further comprising presenting as an alarm condition a distinct color representation of points having a relative phase that is within a predetermined phase difference of 180°.

* * * * *